United States Patent [19]

MacDonald

[11] 4,444,211

[45] Apr. 24, 1984

[54] PIPE BOWL REAMER AND SCOOP

[76] Inventor: Wallace J. MacDonald, 91 Old Petty Harbour Rd., St. John's, Newfoundland, Canada, A1G 1H6

[21] Appl. No.: 354,576

[22] Filed: Mar. 4, 1982

[30] Foreign Application Priority Data

Apr. 16, 1981 [CA] Canada ..... 375672

[51] Int. Cl.[3] ..... A24F 9/00; A24F 9/04

[52] U.S. Cl. ..... 131/246; 131/329

[58] Field of Search ..... 131/246, 329, 247

[56] References Cited

U.S. PATENT DOCUMENTS

| | | | |
|---|---|---|---|
| 1,526,938 | 2/1925 | Sommerfeldt | 131/246 |
| 1,746,086 | 2/1930 | Maier | 131/246 |
| 2,011,720 | 8/1935 | Leidel | 31/246 |
| 2,725,764 | 12/1955 | Seez | 131/246 |

FOREIGN PATENT DOCUMENTS

| | | | |
|---|---|---|---|
| 259721 | 4/1926 | Canada | 131/247 |
| 320969 | 3/1932 | Canada | 131/246 |
| 408565 | 11/1942 | Canada . | |
| 443177 | 7/1947 | Canada . | |
| 461820 | 12/1948 | Canada . | |
| 654573 | 12/1962 | Canada . | |
| 1173279 | 7/1964 | Fed. Rep. of Germany | 131/246 |
| 175138 | 4/1961 | Sweden | 131/246 |
| 289754 | 5/1928 | United Kingdom | 131/246 |
| 573750 | 12/1945 | United Kingdom | 131/246 |

*Primary Examiner*—V. Millin

*Attorney, Agent, or Firm*—Pollock, VandeSande & Priddy

[57] ABSTRACT

The invention disclosed herein is a smoker's implement which serves as both a scoop and a bowl reamer for a smoking pipe. It is a small, one-piece body tapered at both ends, and is made of relatively thin sheet metal or the like, of dimensions adapted to be readily inserted into the bowl of a smoking pipe. This device has two portions, one being the scoop portion and the other being the reamer or cutting portion. The scoop portion (which also serves as a handle for the device when it is being used as a bowl reamer) has smooth edges which uniformly taper toward its end from a point approximately midway of the length of the body. Preferably this portion has a relatively broad, shallow slightly V-shaped depression extending along the axis of the body from its end. The other portion of the body, namely, the reamer or cutting end, has extending inwardly from its end over part of its length, stepped sides or cutting edges. At least the endmost step of this reamer portion is of predetermined height, and serves as a sort of "depth gauge" to control the amount of cutting of hard cake in the pipe bowl. The device is light in weight, is easily carried, and can be easily and inexpensively manufactured.

11 Claims, 3 Drawing Figures

PIPE BOWL REAMER AND SCOOP

The present invention relates to smokers' implements and has particular reference to a single implement or device which serves both as a reamer for scraping and loosening the carbonaceous deposit which generally is present and forms a lining on the interior of the bowl of a smoking pipe, and as a scoop for removing unburned tobacco (wet due to saliva) and ash (burned tobacco) from the bowl, and thus cleaning the bowl, as a preliminary to refilling it with fresh tobacco.

A number of devices of various shapes and configurations are known for cleaning tobacco pipes. Reference may be made, for instance, to U.S. Pat. No. 2,011,720 of William Leidel which shows an elongated laminated shank which is slidable relative to a body portion to present either end of the shank for use as a smoker's tool. To one end there may be attached a curved blade for use as a pipe reamer. Other known pipe reaming devices have two or more adjustable blades, as illustrated in, for instance, U.S. Pat. No. 1,746,086 of J. D. Maier, Canadian Pat. No. 461,820 of J. J. Edmondson, and Canadian Pat. No. 259,721 of H. Gessler. Another type of pipe reamer is illustrated in Canadian Pat. No. 654,573 of Anthony Cuchiara; this device comprises a tube which slidably carries a pair of plate-like elements which project outwardly from the side of the tube, and is rotated within the pipe bowl by turning a handle fastened to the outer end of the tube.

While the known pipe cleaning devices are, in varying degrees, useful for their intended purpose some of these devices are rather complex in their construction, requiring, for instance, several parts or elements which must be fitted together in a particular relationship. Such complexity of construction tends to make the devices rather difficult and/or costly to manufacture. Moreover most known pipe cleaning devices are not designed to be carried on the person. Moreover there is no device of one single piece that I am aware of which can be used for both loosening carbonaceous deposits adhering to the pipe bowl wall and as a scoop for cleaning out the bowl as required for a fresh fill.

An objective of the present invention is to provide a smoker's device or implement which serves as both a scoop and a reamer for a smoking pipe.

Another object of this invention is the provision of a smoker's implement which is of one-piece construction and is simple and easy to make.

A further objective of the invention is to provide a smoker's implement which is small and light in weight, and can be readily carried on a person, eg. in a pocket, and which does not have knife-like cutters.

The present invention, in its broadest aspect, provides a smoker's implement serving as a combined scoop and bowl reamer for a smoking pipe. Said implement comprises a unitary, elongated, lamelliform body having two portions, said body being of dimensions adapted for ready insertion into the bowl of a smoking pipe, and being tapered at both ends. One portion of said body, which serves as said scoop and also as a handle for the implement when the latter is used as a bowl reamer, has smooth edges uniformly tapering toward its end from a point approximately midway of the length of the body. The other portion of the body, which serves as a reamer or cutting end, has stepped sides with cutting edges, extending inwardly from its end over part of the length of said reamer portion, and at least the endmost step of said reamer portion is of predetermined height thereby to control the amount of cutting of hard cake in the pipe bowl.

In a more particular aspect, this invention provides a smoker's implement serving as a combined scoop and bowl reamer for a smoking pipe, said implement comprising a unitary, elongated, lamelliform body having two portions, said body being of dimensions adapted for ready insertion into the bowl of a smoking pipe, and being tapered at both ends. One portion of the body which serves both as said scoop and as a handle for said implement when the latter is used as a bowl reamer, has formed therein a shallow, channel-shaped depression extending longitudinally thereof from one end, along the axis of said body and has smooth edges uniformly tapering toward its end from a point approximately midway of the length of the body. The other portion of the body, which serves as a reamer or cutting end, has stepped sides with cutting edges extending inwardly from its end over part of the length of said reamer portion, and at least the endmost step of said reamer portion is of predetermined height, thereby to control the amount of cutting of hard cake in the pipe bowl.

In order to more clearly understand the nature of my invention reference is made to the accompanying drawings which illustrate by way of example the invention, and in which.

Figure 1:
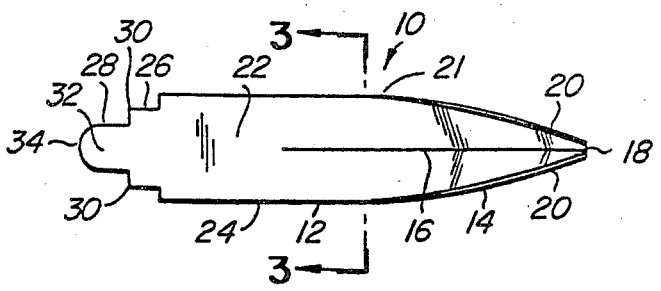
FIG. 1 is a diagram illustrating the device.
Figure 2:
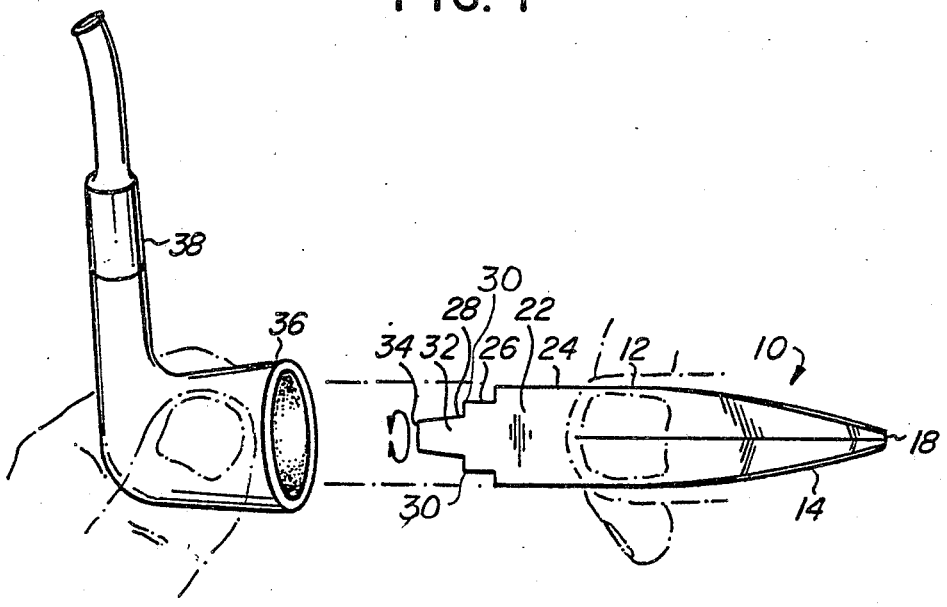
FIG. 2 is a view of the device similar to that of FIG. 1, illustrating its application.
Figure 3:
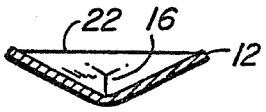
FIG. 3 is a cross-sectional view of the device, shown on a somewhat enlarged scale taken along the line 3—3 of FIG. 1.

As shown in the drawings 10 represents a preferred combined scoop and smoking pipe bowl reamer device of this invention. It comprises a unitary, elongated plate-like or lamelliform body 12 tapered at both ends. One portion 14 of the body, which serves as a scoop, is slightly V-shaped or chevron-shaped in cross-section, there being formed therein a shallow channel-shaped depression 16 extending longitudinally thereof from one end 18 of the device along its axis. The scoop portion 14 usually extends up to approximately one-half of the length of the device, but may extend if desired up to about two-thirds of the length of the device. The scoop portion 14 of body 12 has smooth edges 20 which taper uniformly from a point 21, at which the scoop portion begins, toward end 18. The other portion 22 of the device serves as a smoking pipe bowl reamer or cutting end. Unlike the scoop portion its edges do not taper uniformly toward its end. Rather, a part of this portion may have an approximately rectangular outline; that is, its sides extend outwardly from the center part of body 12 in approximately parallel relationship; and toward the end, say the outermost $\frac{1}{3}$ to $\frac{1}{4}$ of portion 22, the edges 24 define a series of steps (26,28) with straight or angular cutting edges 30. However, the device, in one preferred form, can be designed so that there is a very slight taper from the point (26) at which the steps begin to point 21 where the scoop portion begins. This helps to avoid jamming of the device when in use. The outermost portion 32, terminating at end 34 of the device, serves as a sort of depth gauge, and serves to control the extent of cutting of hard cake in the pipe bowl. End 34 is smooth to avoid scoring of the bottom of the pipe bowl when the device is used, and is preferably slightly rounded so as to conform generally to the contours of the bottom of the pipe bowl.

The device 10 is of suitable dimensions so as to be readily insertable into the bowl of a smoking pipe. The reamer or cutting end 22 is shaped and dimensioned so that, when it is used, it will normally leave a little carbon deposit on the walls of the pipe bowl.

Device 10 of this invention is used most, probably 90% or more, of the time as a scoop. Scoop portion 14 is readily inserted into the bowl of the pipe, and is used to clean out the bowl as required.

When a hard carbonaceous deposit or cake has built up in the bowl 36 of the pipe (38) after a period of use, to a point where this deposit interferes with the smoker's enjoyment and/or where it becomes difficult to insert the scoop into the pipe bowl, cleaning of the pipe bowl becomes necessary. This may conveniently be effected by using the other end, viz. the reaming portion 22, of device 10. The device is grasped, using a thumb and forefinger, by the scoop portion or by the central area of the device and inserted into the center of the pipe bowl. The device is then rotated by hand a few complete turns. The stepped cutting edges of the device cut away the encrusted carbonaceous deposit from the pipe walls as device 10 is rotated. The reaming portion is designed so that when it is rotated it cuts from the top of the pipe bowl inwardly, thus making a path for itself. It is not necessary to "push" the device into the pipe bowl. The two sides of the reamer portion of the device are also scraping edges, and they come into play as the stepped cutting surface cuts a path through the carbon coating. When end 34 of the device contacts the bottom of the pipe bowl the hard cake or deposit will have been loosened so that it can readily be removed from the pipe bowl. Up to about ⅛ inch of the carbonaceous deposit may be left on the inside walls of the pipe, as is considered acceptable. The pipe is then ready for normal use.

The device of this invention may be made in various sizes to accommodate varying sizes of smoking pipe bowls. For most purposes two sizes of the device can be used: normal or regular, and "large". The reamer portion of the "large" size device is about 2 mm. wider than that of the normal or regular size device. My device may conveniently be made from relatively thin sheet metal, but also, if desired or necessary it can be made from other suitable material. My device has the advantage of being small, light in weight and easily carried, and of being easily cleaned, and can be cheaply made in large quantities from a single piece of material. Another advantage of this device is that it does not require any knife-like cutting blades or movable parts. It may conveniently be sold in a suitable container, for instance, in a small plastic bag, jacket or pouch.

Although a particular embodiment of this invention has been described herein in some detail, this is by way of illustration only. It is to be understood that various changes or modifications may suggest themselves to one skilled in the art. For instance, the device could be made flat viz. without the longitudinally-extending shallow channel-shaped depression 16 in the scoop portion as illustrated. It would still be operable, albeit with the disadvantages that the device would have less strength, and that it would be somewhat more difficult to retain on the "scoop" the waste material being removed from a tobacco pipe blow thereby. Also, the number of steps of the cutting or reaming portion can be varied as desired. It is therefore intended that the invention be limited only by the claims which follow.

I claim:

1. A smoker's implement serving as a combined scoop and bowl reamer for a smoking pipe, said implement comprising a unitary, elongated, lamelliform body having a central portion which exhibits the maximum width of said body, said body being of dimensions adapted for ready insertion into the bowl of a smoking pipe, said body being of lesser width than said central portion at both ends of said body to provide a first end portion of said body which is adapted to be used as a scoop and a second end portion of said body, opposite to said first end portion, which is adapted to be used as a bowl reamer, said first end portion of said body which serves as said scoop also being adapted to be used as a handle for said implement when the second end portion of said body is used as a bowl reamer, said first end portion having smooth edges uniformly tapering toward one end of the body from a point on said central portion approximately midway of the length of the body; the second end portion of the body, serving as a reamer or cutting end, having a substantially rectangular part of said maximum width extending from said point partially toward the other end of the body followed by a plurality of inwardly stepped sides with cutting edges extending from said rectangular part to the other end of said body, at least the endmost one of said stepped sides being of predetermined height to control the amount of cutting of hard cake in the pipe bowl.

2. The smoker's implement of claim 1 wherein said first end portion of the body has formed therein a shallow, channel-shaped depression extending longitudinally thereof from said one end along the axis of said body.

3. An implement as defined in claim 2 wherein said shallow channel-shaped depression is slightly V-shaped or chevron-shaped in cross-section.

4. An implement as defined in claim 2 or claim 3 wherein said shallow channel-shaped depression extends longitudinally along the axis of said body approximately one-half the length thereof.

5. An implement according to claim 2 or claim 3 wherein said shallow channel-shaped depression extends longitudinally along the axis of said body up to approximately ⅔ the length thereof.

6. An implement according to claim 1, 2 or 3 wherein said body is formed of sheet metal.

7. An implement according to claim 1, 2 or 3 wherein the outermost end of said second end portion is smooth-edged.

8. An implement according to claim 1, 2 or 3 wherein the stepped sides of said second end portion extend inwardly from said rectangular part for a distance of from about ¼ to about ⅓ of the length of said second end portion.

9. An implement according to claim 1, 2 or 3 wherein the stepped sides of said second end portion have angular cutting edges.

10. An implement according to claim 1, 2 or 3 wherein the sides of said second end portion are very slightly tapered from the point therealong where the stepped sides begin to the point where said second end portion merges with said first end portion.

11. An implement according to claim 1, 2 or 3 wherein the outermost end of said second end portion is smooth-edged and slightly rounded so as to conform generally to the contours of the bottom of the pipe bowl.

* * * * *